United States Patent [19]

Schwab

[11] 4,454,746

[45] Jun. 19, 1984

[54] BLIND RIVETING DEVICE WITH RIVET PIN CONVEYING MEANS

[75] Inventor: Manfred F. Schwab, Wiesbaden, Fed. Rep. of Germany

[73] Assignee: Alfred Honsel Nieten- und Metallwarenfabrik GmbH & Co., Fed. Rep. of Germany

[21] Appl. No.: 318,490

[22] Filed: Nov. 5, 1981

[30] Foreign Application Priority Data

Jul. 1, 1981 [DE] Fed. Rep. of Germany ..... 3125838

[51] Int. Cl.[3] ..... B21D 31/00

[52] U.S. Cl. ..... 72/391; 72/453.17; 72/453.19

[58] Field of Search ..... 72/391, 453.19, 453.17, 72/453.15

[56] References Cited

U.S. PATENT DOCUMENTS 4,275,582 6/1981 Sheffield et al. ..... 72/391
4,275,583 6/1981 Gilbert et al. ..... 72/391

FOREIGN PATENT DOCUMENTS 2154788 11/1971 Fed. Rep. of Germany ..... 72/391
2031779 3/1980 United Kingdom ..... 72/391

*Primary Examiner*—Daniel C. Crane
*Assistant Examiner*—David B. Jones
*Attorney, Agent, or Firm*—Barnes, Kisselle, Raisch, Choate, Whittemore & Hulbert

[57] ABSTRACT

In a blind riveting device having a compressed air feed, the compressed air feed serves not only for the actuating means of the blind riveting device, but also for a compressed air conveying means which transports the rivet pins which are pulled off in the riveting operation, into a container which is disposed at a position remote from the blind riveting device.

9 Claims, 3 Drawing Figures

BLIND RIVETING DEVICE WITH RIVET PIN CONVEYING MEANS

The invention relates to a blind riveting device comprising a compressed air feed, an actuating means which is controllable by the compressed air, and a passage which extends rearwardly through the head of the device from the mouthpiece, for discharge of the rivet pins which have been pulled out.

It is known for the rivet mandrels which are pulled out of the rivet in the riveting operation when blind riveting, to be taken up and collected in a container on the riveting device. This requires the riveting device to be moved in a suitable manner so that the rivet pin or mandrel can pass through a passage into the collecting container which is arranged at the end of the head of the device, that is remote from the mouthpiece. A pivotal movement of this kind places a burden on the operator and not only requires physical force but also requires the operator to be careful and attentive. Particularly when the collecting means is filled with rivet pins, the blind riveting device becomes heavy and handling of the device becomes more difficult and more time-consuming.

The invention is therefore based on the problem of providing a blind riveting device wherein a collecting container which is arranged on the blind riveting device, for receiving the rivet pins, is eliminated, at low technical cost.

The invention provides that the compressed air feed, besides the actuating means, supplies a compressed air conveying means which transports the pulled-out rivet pins through a conveyor conduit into a collecting container which is remote from the blind riveting device.

If the disadvantages involved in a collecting container being mounted on the blind riveting device, namely that the blind riveting device increases in weight as the collecting container is filled, can be accepted, then the collecting container can also be secured to the blind riveting device in per se known manner.

In accordance with an advantageous embodiment of the invention, there is a communication from the compressed air feed to the discharge passage for the rivet pins, and compressed air is introduced into the discharge passage in the discharge direction through that communication.

In this connection, an advantageous embodiment of the invention is characterised in that there is a communication from the compressed air feed to an annular chamber which surrounds the discharge passage behind the mouthpiece, and that a bore which extends inclinedly rearwardly and inwardly carries compressed air from the annular chamber into the discharge passage.

In this arrangement, it is advantageous to provide a plurality of peripherally distributed, inclinedly rearwardly and inwardly extending bores.

An advantageous embodiment of the invention is characterised in that a hose conduit leads from the compressed air feed to a bore in the head of the device, which bore opens into the annular chamber behind the mouthpiece.

Advantageously, the annular chamber is sealed with respect to the head of the device by O-ring seals, and the annular chamber is disposed at a spacing from the clamping chuck means disposed in the mouthpiece.

The invention will be described in greater detail hereinafter by means of an embodiment with reference to the partly diagrammatic drawing.

Figure 1:
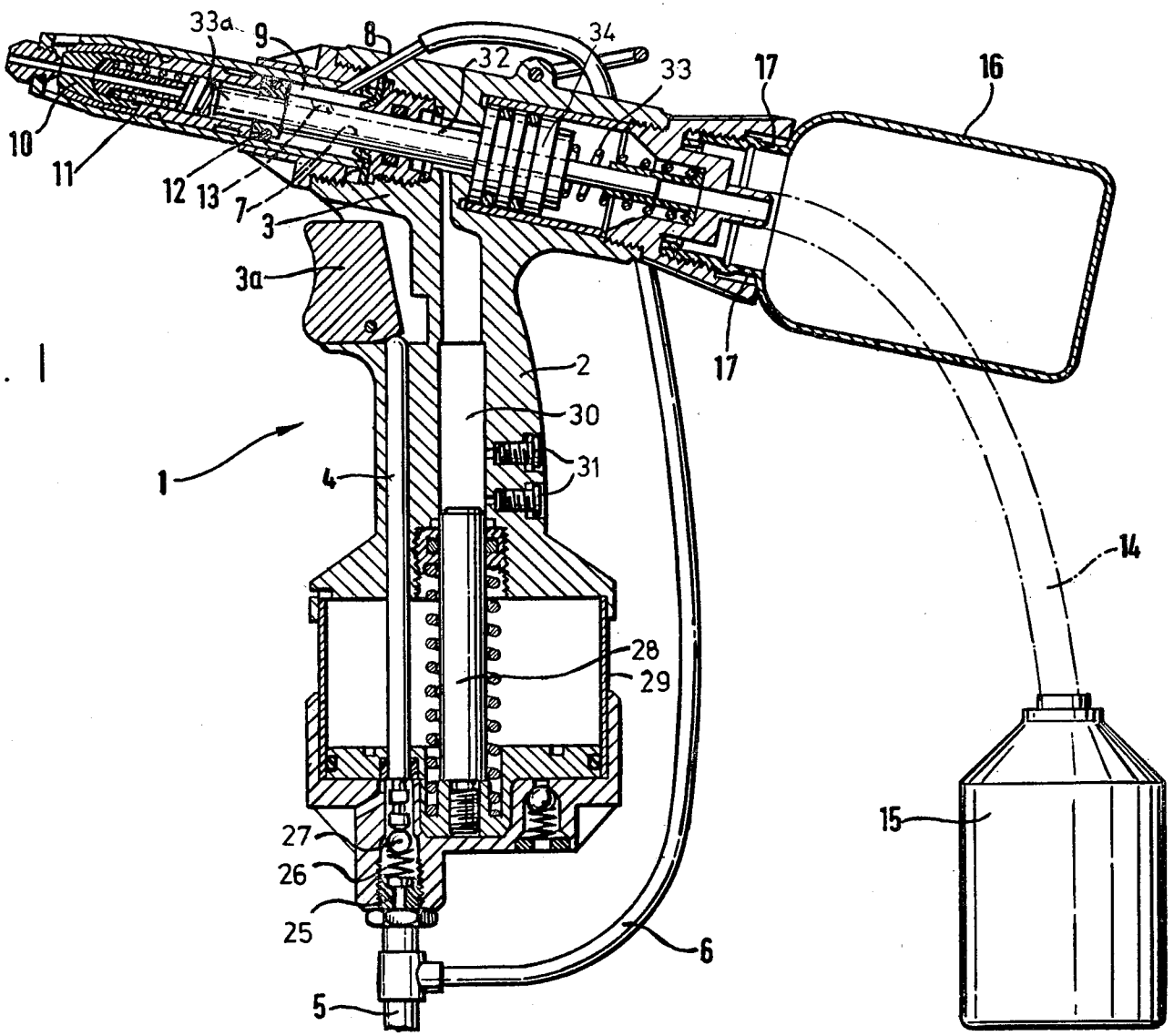
FIG. 1 is a fragmentary part sectional view of a blind riveting device embodying the invention.

FIG. 1 shows a blind riveting device 1 which comprises a handle portion 2 and a head 3, as the main components of the device. The handle portion 2 carries an actuating member 3a which actuates the compressed air-operated blind riveting device 1 by way of a push rod 4.

A compressed air feed 5 is connected to a threaded connecting nipple 25 which can be provided with a filter. A valve spring 26 is disposed in a recess in the nipple 25 and bears against a valve ball member 27. The valve 27 is opened by way of the push rod 4, by the actuating member, whereby the blind riveting device is operated. For this purpose, the arrangement has a pneumatic piston 28 which is disposed in a pneumatic cylinder tube 29. The space 30 above the pneumatic piston 28 is filled with hydraulic oil which can be subsequently introduced into the device by way of the screws 31. Disposed in the head of the device is a hydraulic piston 34, which is braced from the rear by a compression spring 33. A communication leads from the compressed air feed 5 to a discharge tube 32 which together with piston 34 defines passage for the rivet pins, at 7, which is provided in the head 3 of the device. For this purpose, the head 3 of the device has a bore 8 therein, through which the compressed air passes from the communication 6 into an annular chamber 9. The annular chamber 9 is arranged behind the mouthpiee 10 of the blind riveting device 1, at a spacing from the clamping chuck means 11 disposed in the mouthpiece 10. The cylindrical chamber 9 is delimited in an inward direction by the discharge tube 32 and in an outward direction by head 3 of the blind riveting device 1. The annular chamber 9 is sealed with respect to the clamping chuck means 11 in the head portion 10 of the device by O-ring seals 12 so that the compressed air which is introduced into the annular chamber 9 can only issue by way of a bore 13 which is provided in the discharge tube 32 and which leads from the annular chamber 9 into the discharge passage 7 provided in the middle of the discharge tube 32. The bore 13 extends inclinedly rearwardly and inwardly from the annular chamber 9 which surrounds the discharge passage 7. By virtue of this arrangement, the compressed air in the discharge passage 7 moves rearwardly away from the mouthpiece 10 of the head 3 of the device, and the pins or mandrels which are pulled off in the riveting operation are sucked into the discharge passage 7 and conveyed rearwardly by the compressed air. From there, they pass into a conveyor conduit 14 which leads to a collecting container 15 which is disposed at a position remote from the blind riveting device 1. The collecting container can be at a distance of up to 5 meters from the blind riveting device 1. By virtue of this arrangement, the blind riveting device can be handled without handicap and also does not suffer from an increase in weight due to the accumulation of rivet pins from a number of riveting operations.

If however particular circumstances indicate that a collecting container 16 which is secured to the blind riveting device is desirable, then such a collecting container 16 can be secured to the head 3 of the device, at the end remote from the mouthpiece 10. In that case, the rivet pins do not pass into the conveyor conduit 14 which is an alternative possibility, but into the collecting container 16 which is secured to the head of the device; the collecting container 16 has a vent opening 17 through which the compressed air can escape.

In this way, there is thus provided a blind riveting device which is not detrimentally affected in regard to handling thereof, even when a large number of riveting operations are carried out, by virtue of the fact that the rivet pins are discharged into a container which is remote from the device. The conveyor conduit leading from the blind riveting device to the container is of sufficient length in this arrangement so that handling of the device is not detrimentally affected when the device is used in a very wide range of working operations, for example when working at a belt conveyor.

Figure 2:
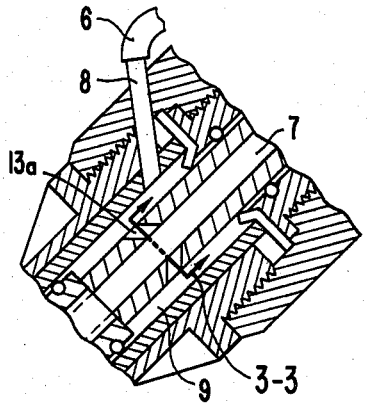
FIG. 2 is a fragmentary sectional view of a modified form of a blind riveting device.
Figure 3:
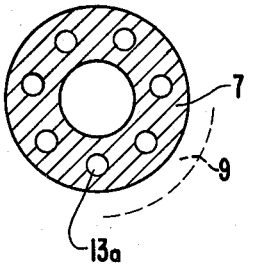
FIG. 3 is a fragmentary sectional view taken along the line 3—3 in FIG. 2.

In the form of riveting device shown in FIGS. 2 and 3, a plurality of bores 13*a* are provided in the discharge tube 7 and are inclined rearwardly and inwardly.

I claim:

1. A blind riveting device comprising a head having a mouthpiece for engaging rivets at its front end, a handle extending from said head, actuating means comprising a piston and cylinder arrangement within said head operable by compressed air to pull rivet pins from rivets, first means for supplying compressed air to said actuating means, said head having a discharge tube extending from said mouthpiece through said head for guiding said rivet pins out of said head, stationary means defining an isolated annular chamber in said head intermediate said mouthpiece and said actuating means and surrounding said discharge tube, second means fixedly connected to said stationary means for supplying compressed air to said annular chamber, and a plurality of bores about said discharge tube inclined rearwardly and inwardly providing communication from the annular chamber into said discharge tube such that compressed air moves rearwardly through said plurality of bores to said discharge tube away from said mouthpiece and conveys the rivet pins rearwardly through the discharge tube and out of the head.

2. A blind riveting device according to claim 1 or 10 including a hose leading from the first means for supplying compressed air to the second means for supplying compressed air.

3. A blind riveting device according to claim 1, or 2 wherein the annular chamber is isolated by O-ring seals.

4. A blind riveting device according to claim 1, 2 or 3 wherein the annular chamber is spaced from the mouthpiece.

5. A blind riveting device according to claim 1 wherein said annular chamber is positioned between said mouthpiece and said actuating means.

6. A blind riveting device according to claim 5 wherein said actuating means comprises a hydraulic piston.

7. A blind riveting device according to claim 1 including a container for receiving the rivet pins.

8. A blind riveting device according to claim 7 wherein said container is mounted on said head.

9. A blind riveting device according to claim 7 wherein said container is remotely positioned with respect to said head and a conduit connects said discharge passage on said head and said container.

* * * * *